US005960481A

United States Patent [19]

Deveer

[11] Patent Number: 5,960,481

[45] Date of Patent: Oct. 5, 1999

[54] LAVATORY SEAT WITH A HYGIENE SAFETY GUARD

[76] Inventor: William B. Deveer, 76-04 Main St. #110, Kew Gardens, N.Y. 11367

[21] Appl. No.: 09/007,468

[22] Filed: Jan. 15, 1998

[51] Int. Cl.[6] ..... A47K 13/00

[52] U.S. Cl. ..... 4/237; 4/661

[58] Field of Search ..... 4/237, DIG. 5, 4/661, 144.3, 234, 239

[56] References Cited

U.S. PATENT DOCUMENTS 3,625,654 12/1971 An Duyne ..... 4/661

4,437,430 3/1984 DeBardeleben ..... 4/661

4,910,815 3/1990 Kelley ..... 4/DIG. 5

5,384,917 1/1995 Epling ..... 4/661

*Primary Examiner*—David J. Walczak

[57] ABSTRACT

A hygiene safety guard that enables male urination without the penis to be placed inside the lavatory bowl when the person is in the process of defecation. This could prevent infection of the urinal tract within the penis which could lead to serious complications. The hygiene safety guard also enables female urination and it would also prevent the dirty water from splashing upward during male and female urination.

1 Claim, 1 Drawing Sheet

LAVATORY SEAT WITH A HYGIENE SAFETY GUARD

CROSS REFERENCE TO RELATED INVENTIONS

Figure 1:
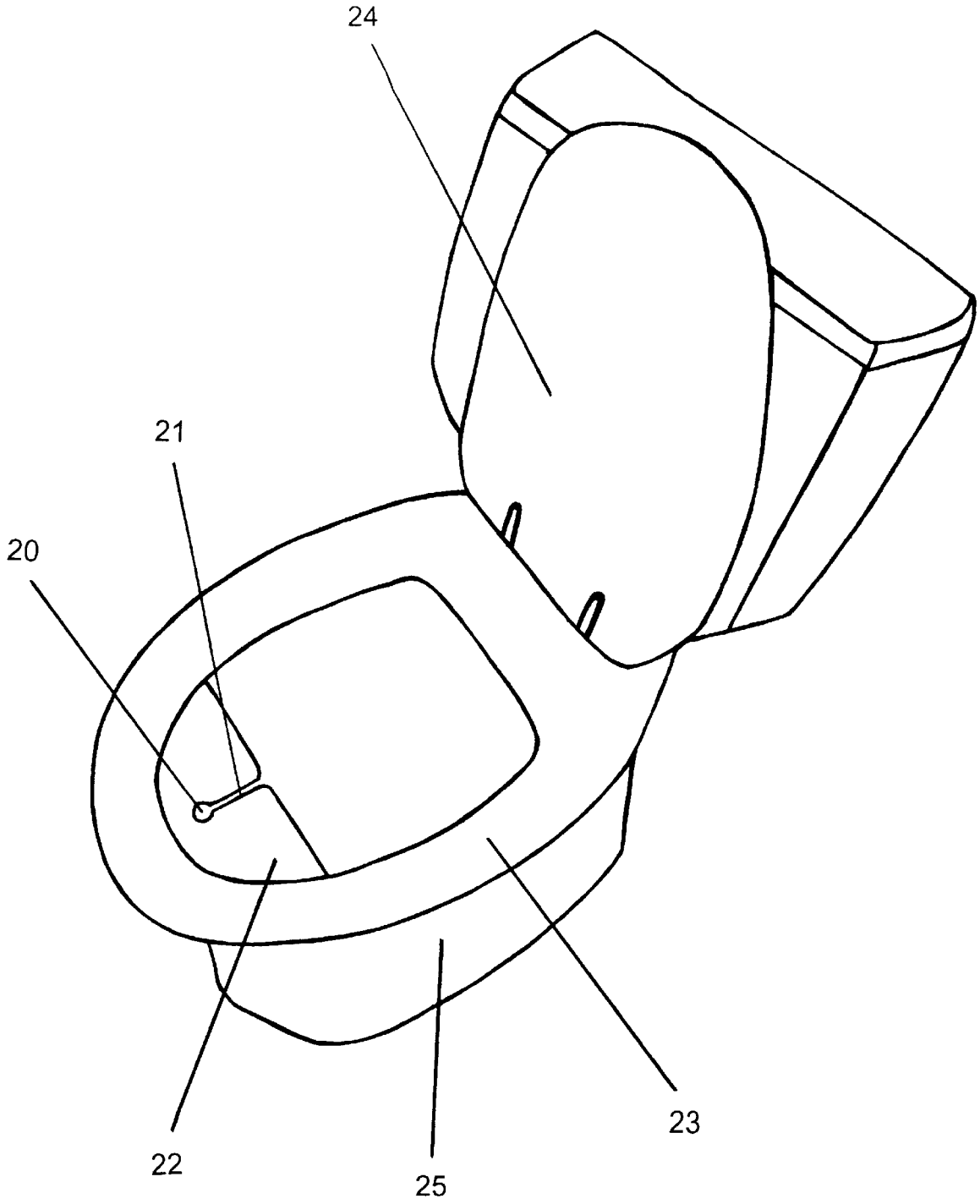

Not Applicable.

BACKGROUND

1. Field of Invention

This invention relates to the lavatory seat which rests on top of the lavatory bowl.

2. Discussion of Prior Art

The lavatory seat in prior art was designed to be placed over the lavatory bowl. They were designed for comfort to the buttocks and thighs when a person was seated on the seat. The design was plain and usually oval in shape. They did not include a hygiene safety guard in combination with a lavatory seat that kept the penis above the lavatory bowl away from the dirty water in the lavatory bowl. Other inventions such as U.S. Pat. No. 4,910,815 Mar. 27, 1990 by Kelly requires the penis to be placed inside the lavatory bowl, thereby risking coming into contact with the dirty water in the bowl. Other patents such as U.S. Pat. No. 4,437,430 Mar. 20, 1984 by DeBardeleben were not designed for human use; Debardeleben's invention was a receptacle for holding cat litter for training cats to use a toilet bowl. U.S. Pat. No. 5,384,917 Jan. 31, 1995 by Epling was designed for adapting the larger lavatory seat (used by adults) for use by children. This invention does not include features for protecting the penis from coming into contact with the dirty water below. These inventions do not have the same combination of a hygiene safety guard affixed permanently to a lavatory seat which protect the male penis from coming into contact with the dirty water below inside the lavatory bowl. They also do not keep the penis at a safe height (at the same level as the lavatory seat) above the dirty water inside the lavatory bowl.

OBJECTS AND ADVANTAGES

My invention is a lavatory seat design that includes a hygiene safety guard that would reduce risk of infection to male genitals when the person is in the process of defecation. The design of my lavatory seat includes a safety guard with a round opening in the front part of the lavatory seat that would allow for male urination without the penis to be placed inside the lavatory bowl; while the person is in the process of defecating. This would prevent infection of the urinary tract inside the penis which may lead to serious complications. Such an infection could turn into a cancer and, may lead to serious complications.

Prior art lavatory seats do not have such a hygiene safety guard.

The design of my invention also enables female urination. The design of the hygiene safety guard has a narrow opening which would enable female urination.

The design of the hygiene safety guard also reduces risk of the dirty water in the lavatory bowl to come into contact with the male genitals, since they are not inside the bowl. Male genitals are also protected since the hygiene safety guard keeps the genitals at the same level as the lavatory seat; this prevents the dirty water in the lavatory bowl from coming into contact with the male genitals through the openings in the hygiene safety guard. The male genitals are kept out of the lavatory bowl and above the bowl; at the same height above the dirty water as the lavatory seat; this is the main advantage of the hygiene safety guard.

DESCRIPTION OF THE DRAWING FIGURES

FIG. 1 shows the lavatory seat with the hygiene safety guard in the front part of the lavatory seat. It also shows the lavatory seat placed on the lavatory bowl.

LIST OF REFERENCE NUMERALS

| REF NO. | PARTS OF THE DRAWINGS |
|---|---|
| 20 | the round opening for male urination |
| 21 | the narrow opening for female urination |
| 22 | the hygiene safety guard |
| 23 | the lavatory seat |
| 24 | the lavatory seat cover |
| 25 | the lavatory bowl |

SUMMARY

The lavatory seat with hygiene safety guard enables male urination without the penis to be inside the lavatory bowl when the person is in the process of defecation. The tip of the penis can be placed on the round opening in front of the hygiene safety guard for urination. This would prevent infection of the urinal tract inside the penis; such an infection may turn into a cancer and lead to serious complications.

The narrow opening leading from the round opening enables female urination as well. The design of the hygiene safety guard also reduces risk of the dirty water in the lavatory bowl to splash upward during male urination since the genitals are above the dirty water; at the same level as the lavatory seat. This enables the penis to be kept at a safe height above the dirty water below (inside the lavatory bowl.) This prevents the dirty water from coming into contact with the genitals through the openings in the hygiene safety guard.

DESCRIPTION OF THE INVENTION

The lavatory seat with hygiene safety guard is a structure (structure 22 in FIG. 1) in the front part of the lavatory seat. This structure has a round opening (opening 20 in FIG. 1) with a diameter that does not allow for the penis to be inserted through the opening (preventing contact with the dirty water in the bowl.) The round opening 20, is in the front part of the hygiene safety guard. A narrow opening (opening 21 in FIG. 1) leading from the round opening in front enables female urination. The hygiene safety guard is rigid and is affixed to and thereby an integrated part of the lavatory seat (seat 23 in FIG. 1) The hygiene safety guard can be made of wood, metal, plastic, or ceramic when painted and sealed thereby creating a non-porous surface. This enables easy cleansing and disinfection.

OPERATION OF INVENTION

The person in the process of defecation would place the tip of the penis on the round opening 20, in front of the hygiene safety guard 22, shown in FIG. 1. This enables male urination without the penis to be inside the lavatory bowl 25, (close to the dirty water) when the person is in the process of defecation. The narrow opening 21, enables female urination.

CONCLUSION, RAMIFICATIONS, AND SCOPE OF INVENTION

My invention enables male urination without the penis to be inside the lavatory bowl when the person is in the process of defecation. This could prevent infection of the urinal tract within the penis; such an infection may turn into a cancer and lead to serious complications; which may lead to loss of life.

My invention also enables female urination through the narrow opening in the hygiene safety guard. It would also prevent the dirty water splashing upward during male urination since the hygiene safety guard keeps the genitals at the same level as the lavatory seat; at a safe height above the dirty water below (inside the lavatory bowl.) This prevents the dirty water in the bowl from coming through the openings in the hygiene safety guard and then into contact with the male genitals.

I claim:

1. A hygiene safety guard for use with a toilet seat mounted over a toilet bowl for protecting a male or female user's genitalia from contacting splashing water in the bowl comprising:

a rigid planar element having a front end portion substantially configured to have the same shape as the front portion of the toilet seat and adapted to be affixed to the front portion of the toilet seat and a rear end portion defining a straight edge which leads from one side of the toilet seat to an opposite side of the toilet seat when said rigid planar element is affixed to the toilet seat;

a round opening extending through said rigid planar element and adapted to receive the tip of a male user's penis thereon to enable the male user to urinate into the bowl while defecating into the bowl without exposing the male user's penis to splashing water within the bowl; and a narrow slit extending through said rigid planar element and extending from said round opening to said straight edge for enabling a female user to urinate into the bowl while defecating into the bowl without exposing the female user's genitalia to splashing water within the bowl.

* * * * *